US009899740B2

(12) United States Patent
Hung et al.

(10) Patent No.: US 9,899,740 B2
(45) **Date of Patent: *Feb. 20, 2018**

(54) HYBRID ANTENNA

(71) Applicant: MediaTek Inc., Hsin-Chu (TW)

(72) Inventors: Kuo-Fong Hung, Changhua (TW); Chia-Wei Chi, Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/384,828

(22) Filed: Dec. 20, 2016

(65) Prior Publication Data

US 2017/0104273 A1 Apr. 13, 2017

Related U.S. Application Data

(63) Continuation of application No. 13/868,383, filed on Apr. 23, 2013, now Pat. No. 9,608,332.

(51) Int. Cl.

| | |
|---|---|
| ***H01Q 1/38*** | (2006.01) |
| ***H01Q 9/42*** | (2006.01) |
| ***H01Q 1/24*** | (2006.01) |
| ***H01Q 5/357*** | (2015.01) |

(52) U.S. Cl.

CPC ..... *H01Q 9/42* (2013.01); *H01Q 1/243* (2013.01); *H01Q 1/38* (2013.01); *H01Q 5/357* (2015.01); *Y10T 29/49016* (2015.01)

(58) Field of Classification Search

CPC ..... H01Q 1/243; H01Q 9/42; H01Q 1/38; H01Q 5/357

See application file for complete search history.

(56) References Cited

U.S. PATENT DOCUMENTS

| | | | | |
|---|---|---|---|---|
| 9,123,994 | B2 | 9/2015 | Lee et al. | |
| 9,608,332 | B2 * | 3/2017 | Hung | H01Q 9/42 |
| 2007/0008221 | A1 | 1/2007 | Tseng | |
| 2009/0256763 | A1 | 10/2009 | Chi | |
| 2011/0109509 | A1 | 5/2011 | Chou et al. | |

FOREIGN PATENT DOCUMENTS

| | | |
|---|---|---|
| CN | 102800928 | 11/2012 |
| CN | 202633498 | 12/2012 |
| JP | 10270920 | 10/1998 |

* cited by examiner

*Primary Examiner* — Dieu H Duong

(74) *Attorney, Agent, or Firm* — McClure, Qualey & Rodack, LLP

(57) ABSTRACT

A hybrid antenna (and related method for manufacturing the antenna) includes a dielectric substrate and a stamping element. The stamping element includes a main radiator, a first holder, a second holder, a feeding element, an extension branch, a first trace, and a first via. The main radiator is substantially disposed above the dielectric substrate. The first holder is coupled to a first end of the main radiator. The second holder is coupled to a second end of the main radiator. The feeding element is coupled to a signal source. The extension branch is substantially disposed below the dielectric substrate, and is coupled between the second holder and the feeding element. The first trace is disposed on a second surface of the dielectric substrate, and the first via is formed through the dielectric substrate, and coupled between an end of the first trace and the first holder.

22 Claims, 8 Drawing Sheets

HYBRID ANTENNA

CROSS REFERENCE TO RELATED APPLICATIONS

This application is a Continuation of application Ser. No. 13/868,383, filed on Apr. 23, 2013, the entirety of which is incorporated by reference herein.

BACKGROUND OF THE INVENTION

Field of the Invention

The disclosure generally relates to a hybrid antenna, and more particularly, relates to a hybrid antenna comprising a stamping element for improving antenna bandwidth and antenna efficiency.

Description of the Related Art

Nowadays, 2G or 3G communications system technology is applied in notebooks, tablet computers, or mobile phones. An RF (Radio Frequency) antenna incorporated in a PCB (Printed Circuit Board) is well known in the art. PCB antenna structures are widely used in wireless communications devices because they are relatively inexpensive to manufacture yet effective for low power communications. However, the drawbacks of PCB antenna structures are narrow bandwidths and poor antenna efficiencies. On the other hand, stamping antenna structures can overcome some drawbacks of PCB antenna structures, but have more complicated manufacturing processes and are more expensive.

BRIEF SUMMARY OF THE INVENTION

In one exemplary embodiment, the disclosure is directed to a hybrid antenna, comprising: a main radiator, a first holder, a second holder, a feeding element, an extension branch, a first trace, and a first via. The main radiator is substantially disposed above the dielectric substrate. The first holder is coupled to a first end of the main radiator. The second holder is coupled to a second end of the main radiator. The feeding element is coupled to a signal source. The extension branch is substantially disposed below the dielectric substrate, and is coupled between the second holder and the feeding element. The first trace is disposed on a second surface of the dielectric substrate, and the first via is formed through the dielectric substrate, and coupled between an end of the first trace and the first holder.

In another embodiment, the disclosure is directed to a method for manufacturing a hybrid antenna, comprising 20. A method for manufacturing a hybrid antenna, comprising the steps of: providing a dielectric substrate, a stamping element, a first trace, and a first via, wherein the stamping element comprises a main radiator, a first holder, a second holder, a feeding element, and an extension branch, wherein the first holder is coupled to a first end of the main radiator, the second holder is coupled to a second end of the main radiator, and the extension branch is coupled between the second holder and the feeding element, wherein the first trace is disposed on a second surface of the dielectric substrate, and wherein the first via is formed through the dielectric substrate, and is coupled between an end of the first trace and the first holder; and performing an SMT (Surface Mounted Technology) process to fix the stamping element to the dielectric substrate, wherein the main radiator is substantially disposed above the dielectric substrate, the extension branch is substantially disposed below the dielectric substrate, and the feeding element is coupled to a signal source.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are described in detail as follows.

Figure 1A:
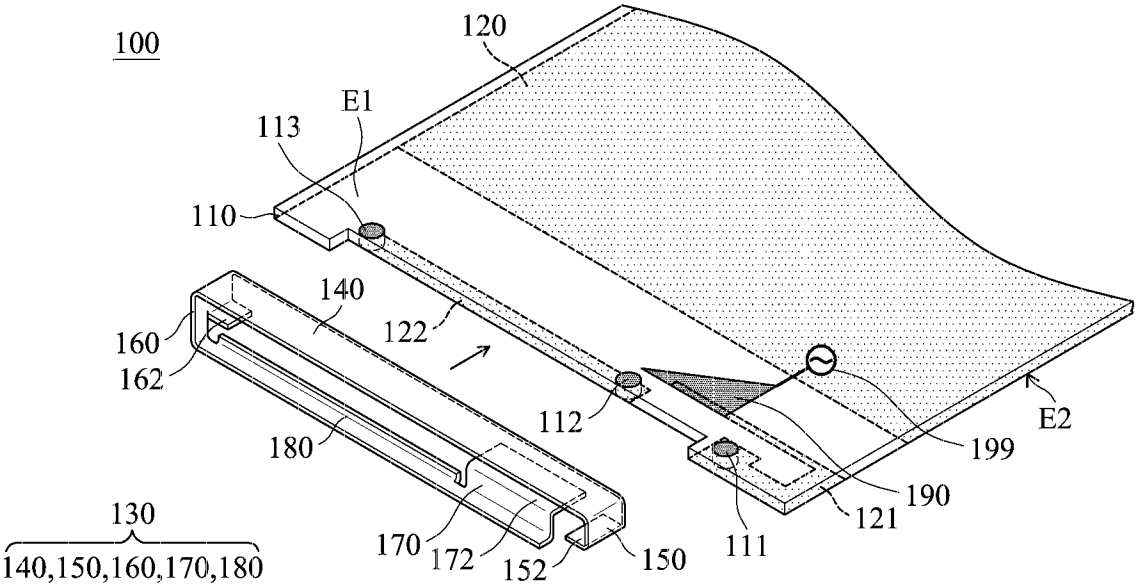
FIG. 1A is a pictorial drawings for illustrating a hybrid antenna according to an embodiment of the invention.
Figure 1B:
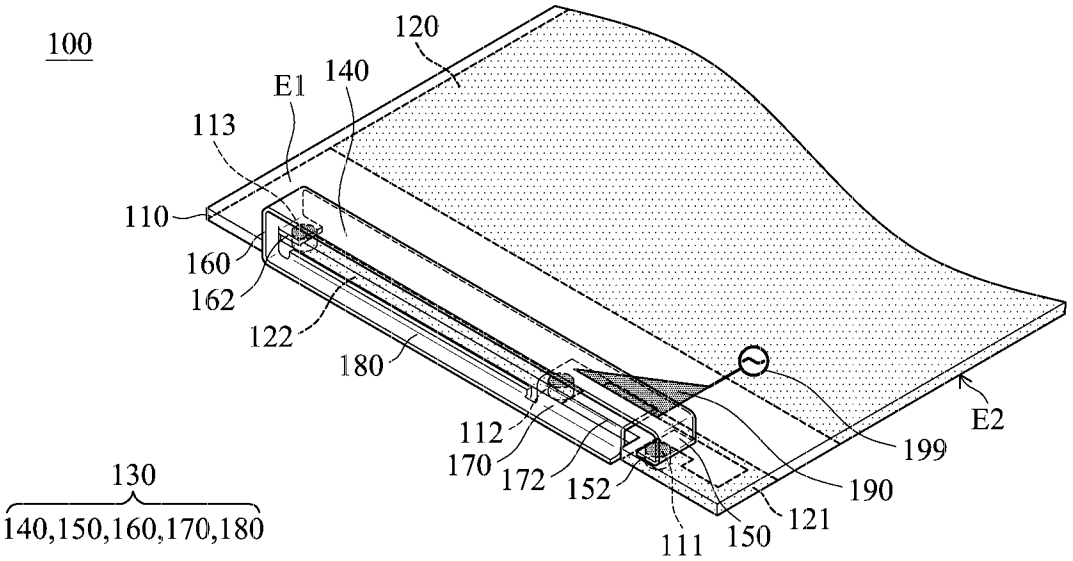
FIG. 1B is a pictorial drawings for illustrating a hybrid antenna according to an embodiment of the invention.
Figure 1C:
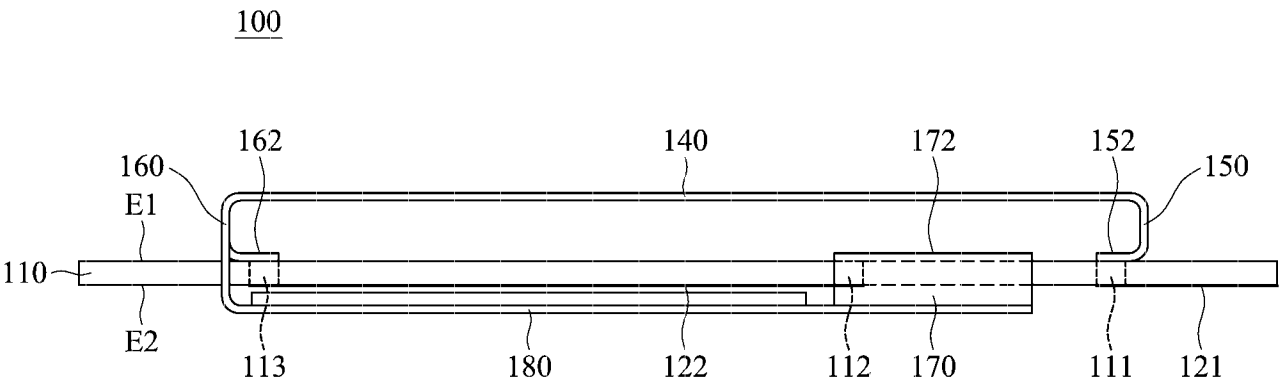
FIG. 1C is a side view for illustrating a hybrid antenna according to an embodiment of the invention.

FIGS. 1A and 1B are pictorial drawings for illustrating a hybrid antenna 100 according to an embodiment of the invention. FIG. 1C is a side view for illustrating the hybrid antenna 100 according to an embodiment of the invention. The hybrid antenna 100 may be applied to a variety of mobile devices, such as a smart phone, a tablet computer, and a notebook computer. The hybrid antenna 100 at least comprises a dielectric substrate 110, a ground plane 120, and a stamping element 130. The dielectric substrate 110 may be a PCB (Printed Circuit Board), such as an FR4 (Flame Resistant 4) substrate. The ground plane 120 and the stamping element 130 may be made of conductive materials, such as silver, copper, or aluminum. Note that in a preferred embodiment, the stamping element 130 is fixed to the dielectric substrate 110 (FIGS. 1B and 1C), but they are shown as two separate components (FIG. 1A) to be understood easily.

The dielectric substrate 110 has a first surface E1 and a second surface E2. The first surface E1 is opposite to the second surface E2. In some embodiments, at least a portion of the stamping element 130 is disposed on the first surface E1 of the dielectric substrate 110, and the ground plane 120 is disposed on the second surface E2 of the dielectric substrate 110. In other embodiments, the ground plane 120 and the portion of the stamping element 130 are disposed on a same surface of the dielectric substrate 110. The dielectric substrate 110 may be further known as "a virtual plane" in the disclosure.

The stamping element 130 comprises a main radiator 140, a first holder 150, a second holder 160, a feeding element 170, and an extension branch 180. The main radiator 140 is separate from and substantially parallel to the dielectric substrate 110. In some embodiments, the main radiator 140 substantially has a straight-line shape. The first holder 150 is coupled to a first end of the main radiator 140, and the second holder 160 is coupled to a second end of the main radiator 140, wherein the first end is opposite to the second end. The first holder 150 and the second holder 160 are soldered on the first surface E1 of the dielectric substrate 110, and are both substantially perpendicular to the main radiator 140. In some embodiments, the main radiator 140 further comprises a first meandering structure, which may substantially have an S-shape, a W-shape, or a U-shape. The feeding element 170 is coupled to a signal source 199. The signal source 199 is configured to excite the hybrid antenna 100. The extension branch 180 is coupled between the second holder 160 and the feeding element 170. In some embodiments, the extension branch 180 further comprises a second meandering structure, which may substantially have an S-shape, a W-shape, or a U-shape. The feeding element 170 comprises a feeding platform 172 coupled to the signal source 199. The feeding platform 172 is soldered on the first surface E1 of the dielectric substrate 110, and is substantially disposed between the main radiator 140 and the dielectric substrate 110. In some embodiments, the feeding platform 172 substantially has a rectangular shape. A resonant current path of the hybrid antenna 100 is from the feeding element 170 through the extension branch 180, the second holder 160, and the main radiator 140 to the first holder 150. Note that the stamping element 130 is configured as a main radiation portion of the hybrid antenna 100. In a preferred embodiment, the main radiator 140 of the stamping element 130 is substantially disposed above the dielectric substrate 110, and the extension branch 180 of the stamping element 130 is substantially disposed below the dielectric substrate 110. In comparison to a convention design including all antenna elements disposed above a PCB, the design of the invention can effectively reduce the total height of the hybrid antenna 100.

In some embodiments, the hybrid antenna 100 may further comprise a taper element 190. The taper element 190 is disposed on the first surface E1 of the dielectric substrate 110, and is coupled between the feeding platform 172 and the signal source 199. In some embodiments, the taper element 190 substantially has a triangular shape. More particularly, a narrow portion of the taper element 190 is coupled to the signal source 199, and a wide portion of the taper element 190 is coupled to the feeding platform 172. The taper element 190 is an optional conductive component configured to increase the bandwidth of the hybrid antenna 100, and it may be eliminated in other embodiments.

In some embodiments, the hybrid antenna 100 may further comprise a first via 111, a second via 112, a third via 113, a first trace 121, and a second trace 122. The first trace 121 is disposed on the second surface E2 of the dielectric substrate 110. In some embodiments, the first trace 121 substantially has a U-shape. The first via 111 is formed through the dielectric substrate 110, and is coupled between an end of the first trace 121 and the first holder 150. The second trace 122 is disposed on the second surface E2 of the dielectric substrate 110. In some embodiments, the second trace 122 substantially has a straight-line shape. The second via 112 is formed through the dielectric substrate 110, and is coupled between a first end of the second trace 122 and the feeding platform 172. The third via 113 is formed through the dielectric substrate 110, and is coupled between a second end of the second trace 122 and the second holder 160. The second trace 122 is coupled in parallel to the extension branch 180, and provides an additional resonant current path. In some embodiments, any of the first trace 121 and the second trace 122 further comprises a third meandering structure, which may substantially have an S-shape, a W-shape, or a U-shape. In some embodiments, the first holder 150 comprises a first protrusion 152, and the second holder 160 comprises a second protrusion 162. The first protrusion 152 is soldered on the first surface E1 of the dielectric substrate 110 and is coupled to the first via 111. The second protrusion 162 is soldered on the first surface E1 of the dielectric substrate 110 and is coupled to the third via 113. The first protrusion 152 and the second protrusion 162 may extend toward each other. In some embodiments, each of the first protrusion 152 and the second protrusion 162 substantially has a rectangular shape. In another embodiment, the first trace 121 and the second trace 122 are both disposed on the first surface E1 of the dielectric substrate 110 (not shown), and are respectively directly coupled to the first holder 150 and the second holder 160, instead of being coupled through the first via 111, the second via 112, and the third via 113. The first via 111, the second via 112, the third via 113, the first trace 121, and the second trace 122 are optional conductive components configured to adjust impedance matching of the hybrid antenna 100, and they may be eliminated in other embodiments.

In the invention, the stamping element 130 is designed to be partially above and partially below the dielectric substrate 110 (or a virtual plane) to reduce the total height of the hybrid antenna 100. The main radiator 140 of the stamping element 130 is supported by the first holder 150 and the second holder 160 such that the hybrid antenna 100 is robust and the manufacturing of SMDs (Surface Mount Devices) is simplified. When an input signal is fed to the hybrid antenna 100, the main radiator 140 has the largest current density among the hybrid antenna 100. Since the main radiator 140 is separate from the dielectric substrate 110 and is almost not negatively affected by metal components disposed on the dielectric substrate 110, the radiation efficiency and bandwidth of the hybrid antenna 100 is effectively improved. Furthermore, one or more traces disposed on the dielectric substrate 110 may be included and integrated with the stamping element 130, and accordingly the hybrid antenna 100 has advantages of a stamping antenna structure and a PCB antenna structure. To be brief, the invention has at least the advantages of a small antenna size, low cost, a simple manufacturing process, robustness, and good radiation performance. The invention may suitably be applied to a variety of small mobile devices.

In some embodiments, an SMT (Surface Mounted Technology) process may be performed to solder one or more portions of the stamping element 130 onto the dielectric substrate 110. As to the SMT process, soldering paste is first attached to one or more specific positions of the dielectric substrate 110, and after the stamping element 130 is appropriately located, the soldering pastes are heated and melted to fix the stamping element 130. The manufacturing of the invention may be further improved during the SMT process. Please refer to the following embodiments.

Figure 2:
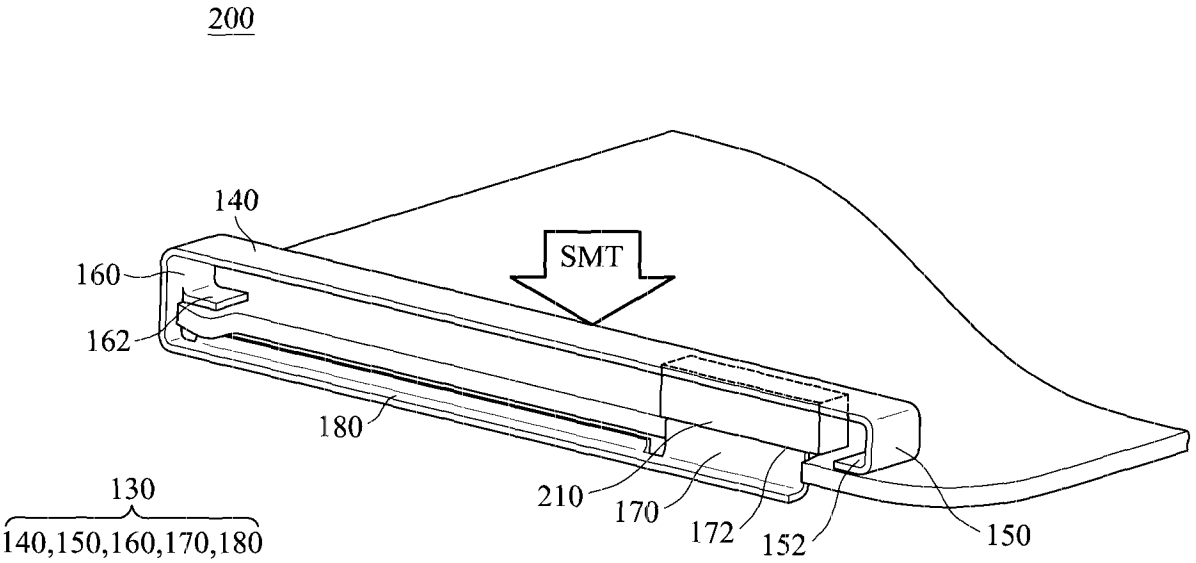
FIG. 2 is a diagram for illustrating a hybrid antenna and the manufacturing thereof according to an embodiment of the invention.

FIG. 2 is a diagram for illustrating a hybrid antenna 200 and the manufacturing thereof according to an embodiment of the invention. FIG. 2 is similar to FIGS. 1A, 1B, and 1C. In the embodiment, the hybrid antenna 200 further comprises a plastic fixture 210. The plastic fixture 210 is disposed between the main radiator 140 and the feeding platform 172, and touches both of them. When an SMT process is performed to fix the stamping element 130 to the dielectric substrate 110, the plastic fixture 210 is configured to maintain the desired shape of the stamping element 130 and to increase stability of the stamping element 130. In some embodiments, the plastic fixture 210 may be eliminated after the SMT process. Other features of the hybrid antenna 200 of FIG. 2 are similar to those of the hybrid antenna 100 of FIGS. 1A, 1B, and 1C. Accordingly, the two embodiments can achieve similar performances.

Figure 3A:
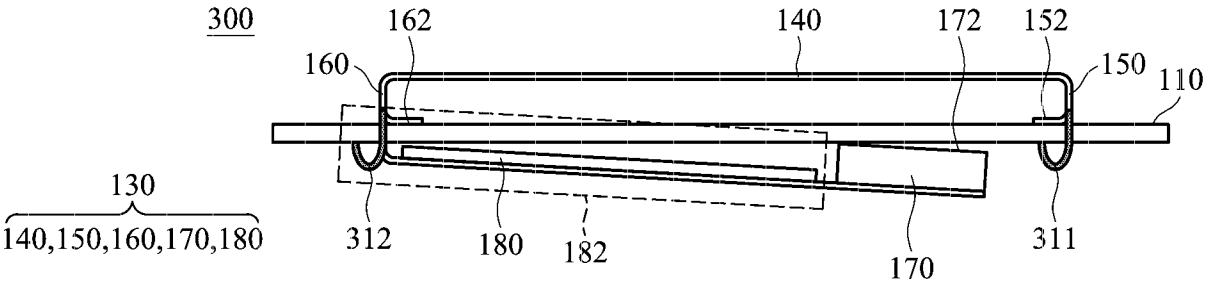
FIG. 3A is a diagram for illustrating a hybrid antenna and the manufacturing thereof according to an embodiment of the invention.
Figure 3B:
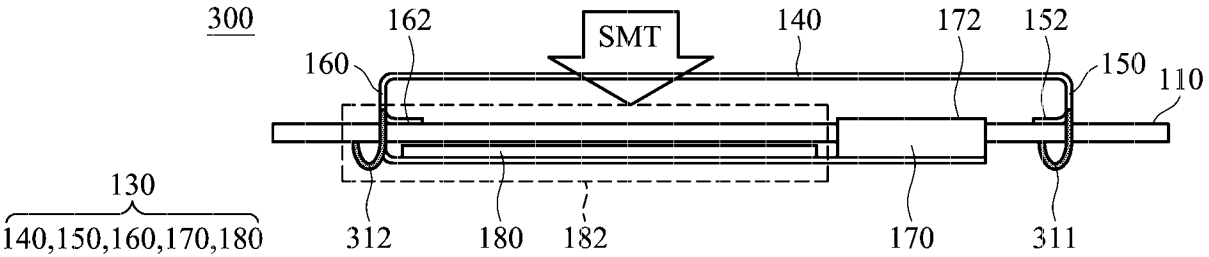
FIG. 3B is a diagram for illustrating a hybrid antenna according to an embodiment of the invention.

FIGS. 3A and 3B are diagrams for illustrating a hybrid antenna 300 and the manufacturing thereof according to an embodiment of the invention. FIGS. 3A and 3B are similar to FIGS. 1A, 1B, and 1C. In the embodiment, the first holder 150 and the second holder 160 are fixed to the dielectric substrate 110 by a first location pin 311 and a second location pin 312, respectively. As shown in FIG. 3A, the extension branch 180 comprises a slight bend 182 which is originally not parallel to the main radiator 140. As shown in FIG. 3B, when an SMT process is performed to fix the stamping element 130 to the dielectric substrate 110, the slight bend 182 of the extension branch 180 is forced to be parallel to the main radiator 140 and the dielectric substrate 110, and generates elastic force to increase stability of the stamping element 130. Other features of the hybrid antenna 300 of FIGS. 3A and 3B are similar to those of the hybrid antenna 100 of FIGS. 1A, 1B, and 1C. Accordingly, the two embodiments can achieve similar performances.

Figure 4:
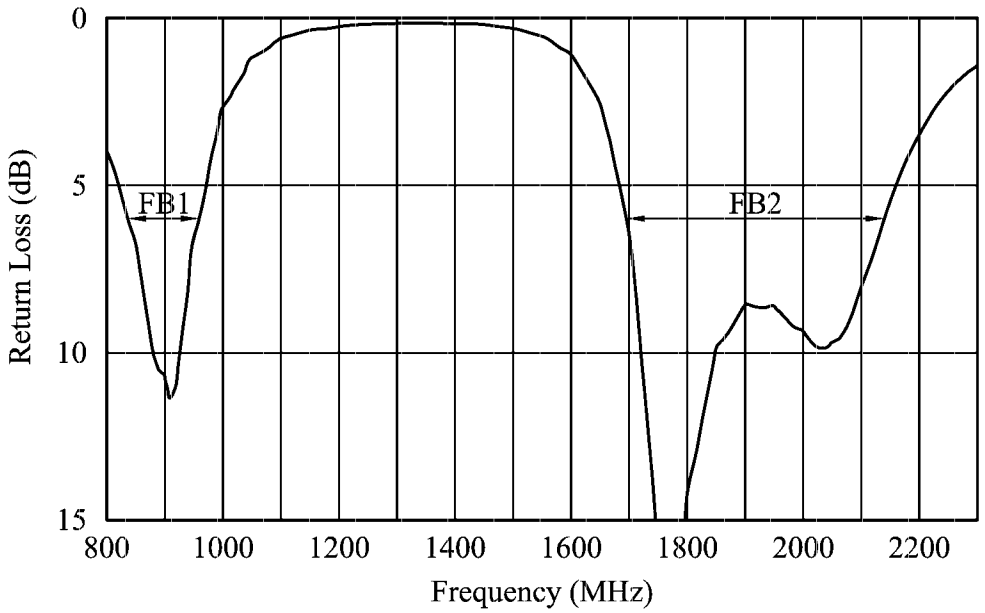
FIG. 4 is a diagram for illustrating return loss of a hybrid antenna according to an embodiment of the invention.

FIG. 4 is a diagram for illustrating return loss of the hybrid antenna according to an embodiment of the invention. The horizontal axis represents operation frequency (MHz), and the vertical axis represents return loss (dB). According to the criterion of 6 dB return loss, the hybrid antenna of the invention at least covers a first band FB1 and a second band FB2. In a preferred embodiment, the first band FB1 is approximately from 824 MHz to 960 MHz, and the second band FB2 is approximately from 1710 MHz to 2170 MHz.

Figure 5:
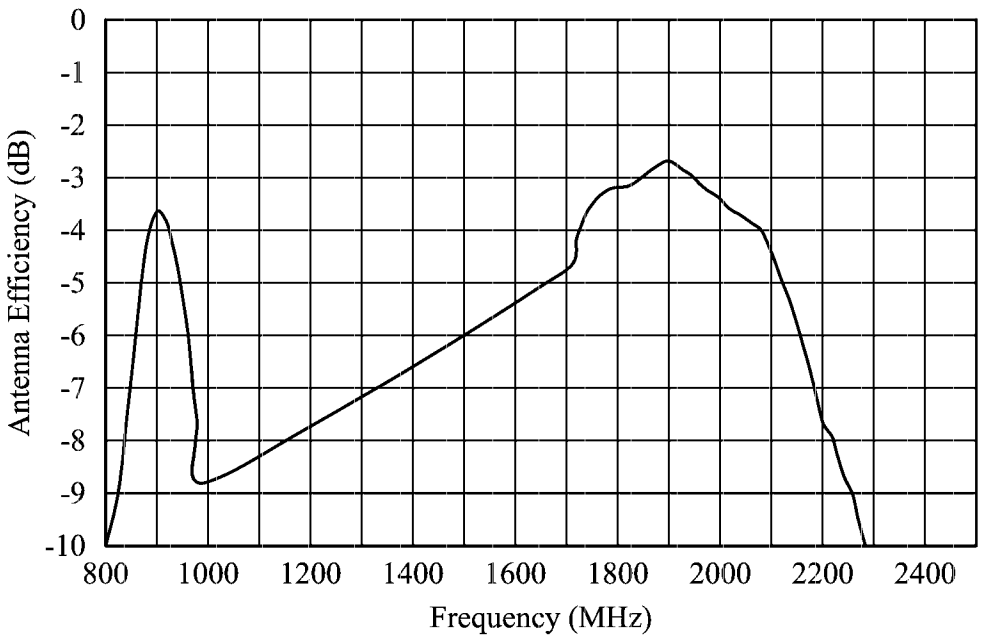
FIG. 5 is a diagram for illustrating antenna efficiency of a hybrid antenna according to an embodiment of the invention.

FIG. 5 is a diagram for illustrating antenna efficiency of the hybrid antenna according to an embodiment of the invention. The horizontal axis represents operation frequency (MHz), and the vertical axis represents antenna efficiency (dB). As shown in FIG. 5, the hybrid antenna of the invention has good antenna efficiency in both of the first band FB1 and the second band FB2, thus, the antenna efficiency may meet various application requirements.

Figure 6:
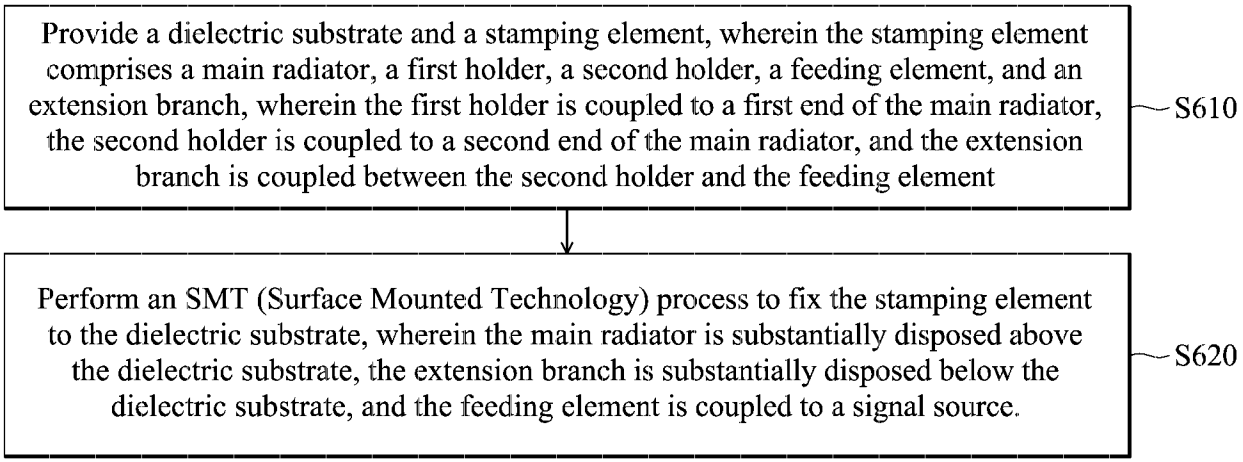
FIG. 6 is a flowchart for illustrating a method for manufacturing a hybrid antenna according to an embodiment of the invention.

FIG. 6 is a flowchart for illustrating a method for manufacturing a hybrid antenna according to an embodiment of the invention. To begin, in step S610, a dielectric substrate and a stamping element are provided, wherein the stamping element comprises a main radiator, a first holder, a second holder, a feeding element, and an extension branch, wherein the first holder is coupled to a first end of the main radiator, the second holder is coupled to a second end of the main radiator, and the extension branch is coupled between the second holder and the feeding element. Finally, in step S620, an SMT (Surface Mounted Technology) process is performed to fix the stamping element to the dielectric substrate, wherein the main radiator is substantially disposed above the dielectric substrate, the extension branch is substantially disposed below the dielectric substrate, and the feeding element is coupled to a signal source. Note that every detailed feature of the embodiments of FIGS. 1-5 may be applied to the method of FIG. 6.

It should be understood that the above-mentioned element size, element shapes, and frequency ranges are not used to limit the invention. An antenna designer can adjust these settings according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hybrid antenna, comprising:
- a dielectric substrate;
- a stamping element, comprising:
- a main radiator, substantially disposed above the dielectric substrate;
- a first holder, coupled to a first end of the main radiator;
- a second holder, coupled to a second end of the main radiator;
- a feeding element, coupled to a signal source; and
- an extension branch, substantially disposed below the dielectric substrate, and coupled between the second holder and the feeding element;
- a first trace, disposed on a second surface of the dielectric substrate; and
- a first via, formed through the dielectric substrate, and coupled between an end of the first trace and the first holder.

2. The hybrid antenna as claimed in claim 1, wherein the main radiator is separate from and substantially parallel to the dielectric substrate.

3. The hybrid antenna as claimed in claim 1, wherein the main radiator substantially has a straight-line shape.

4. The hybrid antenna as claimed in claim 1, wherein the first holder and the second holder are soldered on a first surface of the dielectric substrate and are substantially perpendicular to the main radiator.

5. The hybrid antenna as claimed in claim 4, further comprising:
- a ground plane, disposed on the second surface of the dielectric substrate.

6. The hybrid antenna as claimed in claim 4, wherein the feeding element comprises a feeding platform soldered on the first surface of the dielectric substrate.

7. The hybrid antenna as claimed in claim 6, wherein the feeding platform is substantially disposed between the main radiator and the dielectric substrate.

8. The hybrid antenna as claimed in claim 6, further comprising:
- a second trace, disposed on the second surface of the dielectric substrate;
- a second via, formed through the dielectric substrate, and coupled between a first end of the second trace and the feeding platform; and
- a third via, formed through the dielectric substrate, and coupled between a second end of the second trace and the second holder.

9. The hybrid antenna as claimed in claim 8, wherein the second holder comprises a second protrusion, and the second protrusion is soldered on the first surface of the dielectric substrate and is coupled to the third via.

10. The hybrid antenna as claimed in claim 9, wherein the second protrusion substantially has a rectangular shape.

11. The hybrid antenna as claimed in claim 8, wherein the second trace substantially has a straight-line shape.

12. The hybrid antenna as claimed in claim 6, further comprising:

a plastic fixture, disposed between the main radiator and the feeding platform, wherein when an SMT (Surface Mounted Technology) process is performed to fix the stamping element to the dielectric substrate, the plastic fixture is configured to increase stability of the stamping element.

13. The hybrid antenna as claimed in claim 6, wherein the feeding platform substantially has a rectangular shape.

14. The hybrid antenna as claimed in claim 6, further comprising:

a taper element, disposed on the first surface of the dielectric substrate, and coupled between the feeding platform and the signal source.

15. The hybrid antenna as claimed in claim 14, wherein the taper element substantially has a triangular shape.

16. The hybrid antenna as claimed in claim 1, wherein the first holder comprises a first protrusion, and the first protrusion is soldered on the first surface of the dielectric substrate and is coupled to the first via.

17. The hybrid antenna as claimed in claim 16, wherein the first protrusion substantially has a rectangular shape.

18. The hybrid antenna as claimed in claim 1, wherein the first trace substantially has a U-shape.

19. The hybrid antenna as claimed in claim 1, wherein the hybrid antenna is configured to cover a first band and a second band, and the first band is approximately from 824 MHz to 960 MHz, and the second band is approximately from 1710 MHz to 2170 MHz.

20. A method for manufacturing a hybrid antenna, comprising the steps of:

providing a dielectric substrate, a stamping element, a first trace, and a first via, wherein the stamping element comprises a main radiator, a first holder, a second holder, a feeding element, and an extension branch, wherein the first holder is coupled to a first end of the main radiator, the second holder is coupled to a second end of the main radiator, and the extension branch is coupled between the second holder and the feeding element, wherein the first trace is disposed on a second surface of the dielectric substrate, and wherein the first via is formed through the dielectric substrate, and is coupled between an end of the first trace and the first holder; and performing an SMT (Surface Mounted Technology) process to fix the stamping element to the dielectric substrate, wherein the main radiator is substantially disposed above the dielectric substrate, the extension branch is substantially disposed below the dielectric substrate, and the feeding element is coupled to a signal source.

21. The method as claimed in claim 20, wherein the step of performing the SMT process further comprises:

soldering the first holder, the second holder, and a feeding platform of the feeding element onto a first surface of the dielectric substrate.

22. The method as claimed in claim 20, wherein the step of performing the SMT process further comprises:

disposing a plastic fixture between the main radiator and a feeding platform of the feeding element to increase stability of the stamping element.

* * * * *